United States Patent [19]

Ellender, Jr.

[11] 3,971,713

[45] July 27, 1976

[54] PROCESS FOR REMOVING SULFUR FROM CRUDE OIL

[76] Inventor: Robert D. Ellender, Jr., Star Rte. 2, Box 357, Sulphur, La. 70663

[22] Filed: May 9, 1974

[21] Appl. No.: 468,388

Related U.S. Application Data

[63] Continuation-in-part of Ser. No. 421,127, Dec. 3, 1973, Pat. No. 3,850,745.

[52] U.S. Cl. ..... 208/226; 208/283

[51] Int. Cl.[2] ..... C10G 19/00

[58] Field of Search ..... 208/226, 230, 283, 284, 208/227, 229

[56] References Cited

UNITED STATES PATENTS

| | | | |
|---|---|---|---|
| 507,441 | 10/1893 | Koehler | 208/229 |
| 551,941 | 12/1895 | Amend et al. | 208/229 |
| 1,357,224 | 11/1920 | Cobb | 208/229 |
| 2,293,898 | 8/1942 | Hancock | 208/226 |
| 2,364,390 | 12/1944 | Schaafsma | 208/226 |

*Primary Examiner*—Delbert E. Gantz
*Assistant Examiner*—James W. Hellwege
*Attorney, Agent, or Firm*—Roy, Kiesel, Patterson, Hudson & Abadie

[57] ABSTRACT

A process for removing sulfur from crude oil by contacting with calcium hydroxide containing material at atmospheric pressures and temperatures less than about 100°F.

9 Claims, No Drawings

PROCESS FOR REMOVING SULFUR FROM CRUDE OIL

RELATED APPLICATIONS

This is a continuation-in-part of patent application Ser. No. 421,127, entitled "A Process for Removing Sulfur from Crude Oil" filed Dec. 3, 1973, by the same inventor, now U.S. Pat. No. 3,850,745. All disclosures and parts of the patent application are intended to be incorporated in this application and to become a part hereof.

BACKGROUND OF THE INVENTION

1. Field of the Invention

This invention relates broadly to the treating of petroleum crude oil, and more particularly to the removal of sulfur from the crude oil.

2. Prior Art

With the increasing emphasis on pollution and the resulting demand for low sulfur content petroleum crude oil, a severe need for economically producing low sulfur crude has arisen in view of the shortage of natural low sulfur crude.

In most oil refineries today the sulfur is generally removed after the crude oil has been fractionated which requires the use of different desulfurization processes, as well as expensive equipment which have high maintenance costs and require extreme operating conditions. Examples of prior art processes can be seen in U.S. Pat. Nos. 59,177, 1,942,054, 1,954,116, 2,177,343, 2,321,290, 2,322,554, 2,348,543, 2,361,651, 2,481,300, 2,772,211, 3,294,678, 3,402,998 and 3,699,037. However, these processes are not readily adapted to treating crude oil.

SUMMARY OF THE INVENTION

It is, therefore, an object of this invention to provide a desulfurization process for the treatment of crude oil.

Another object of this invention is to provide a desulfurization process for treating crude oil which employs moderate operating conditions.

Still another object of this invention is to provide a desulfurization process for treating crude oil which will reduce the need for further downstream desulfurization processes.

Other objects and advantages of this invention will become apparent from the ensuing descriptions of the invention.

Accordingly, crude oil is contacted with a calcium hydroxide containing material at atmospheric pressures and at temperatures less than about 100°F.

PREFERRED EMBODIMENTS OF THE INVENTION

The use of calcium hydroxide in desulfurization of fractionated products is well known. In each of these processes, the calcium hydroxide, with or without other desulfurizing agents, is contacted with the fractionated products at either high temperatures or pressure, or both. In these processes, the temperatures, pressures and other operating conditions depend upon the type of sulfur compounds found in the fractionated products, the fractionated product being treated, as well as other factors. However, none appear satisfactory unless there is at last either high temperature or low pressure. Therefore, it is surprising that a low temperature, low pressure calcium hydroxide desulfurization process for treating crude oil could work. It has been found that by contacting a calcium-hydroxide containing material directly with crude oil at basically atmospheric pressure and temperatures below about 100°F that the sulfur level of the crude oil can be reduced more than 50% and in most cases below 1% by weight.

Calcium hydroxide-containing material that can be used include industrial lime, although not necessarily limited thereto, and more preferably a high calcium marble hydrated lime that is a 200-mesh in powder form. As is seen in the examples below, the marble hydrated lime results in a lower sulfur content and a still lower sulfur content if it is in powder form having an average size of 200-mesh.

EXAMPLE 1

A treating vessel was filled with one (1) quart of West Texas Sour crude oil having a sulfur content of 1.67 weight percent before treatment. The crude oil was maintained at atmospheric pressure and at a temperature of about 82°F. Next, two (2) ounces of 200-mesh powdered Batesville marble hydrated lime was uniformly poured over the top of the crude oil and allowed to perculate down through the crude oil. After all the hydrated lime had completely perculated through the crude oil and had settled at the bottom of the treating vessel a sample of the treated crude oil was removed and tested for sulfur content. These steps were repeated at the same temperature and pressure of the same crude oil, except that the calcium hydroxide-containing material was changed to a Pelican State lime, a non-powdered pelleted lime, and then to an industrial lime. The results of these tests are given below in Table 1.

Table 1

Effect of Type of $Ca(OH)_2$ Material Used

| TYPE OF $Ca(OH)_2$ MATERIAL USED | SULFUR CONTENT BEFORE TREATMENT IN WEIGHT PERCENT | SULFUR CONTENT AFTER TREATMENT IN WEIGHT PERCENT |
|---|---|---|
| 200-mesh powdered hydrated lime | 1.67 | 0.52 |
| Pelican State | 1.67 | 0.75 |
| Industrial Lime | 1.67 | 1.13 |
| Pelleted Lime | 1.67 | 1.67 |

In contacting the calcium hydroxide-containing material with the crude oil, it is important that as much as possible of the crude oil comes into contact with the material. For this reason, it is preferred that the mixture be agitated by any of the various known means such as revolving blades, etc. If no agitation is to be used, hen it is preferred that the calcium hydroxide-containing material be poured into the crude oil and not vice versa as that could result in caking of the calcium hydroxide-containing material causing a loss in its sulfur removing efficiency.

It is also preferred that the calcium hydroxide-containing material be contacted with the crude oil in a non-aqueous environment so as not to impair its sulfur removing capabilities as seen in the example results below.

EXAMPLE 2

A treating vessel was filled with 55 gallon drums of Arabian crude oil having an initial sulfur level of 2.52 weight percent and maintained at atmospheric pressures and at about 50°F. To this crude oil was added 12 pounds of 200-mesh powdered marble hydrated lime which was allowed to perculate through the crude oil. After all of the hydrated lime had settled the treated crude oil as examined for sulfur content. The above test was then repeated, except that 12 gallons of water was added to the crude oil before the hydrated lime. The treated crude oil was then tested for sulfur content. The results of these tests are found in Table 2 below.

Table 2

Effect of $H_2O$ on sulfur level

| MIXTURE | SULFUR CONTENT AFTER TREATMENT |
|---|---|
| Crude + Hydrated lime | .78 |
| Crude + Water + hydrated lime | 2.16 |

The amount of calcium hydroxide-containing material necessary to achieve the desired reduction in sulfur level depends upon, among other things, the type of crude oil being treated, the type of calcium hydroxide-containing material being used, the type of contacting (perculation or agitation) and the final sulfur content desired. Generally, it has been found that when using hydrated lime that from 1 to 4 ounces of hydrated lime per quart of crude oil will reduce substantially the sulfur content, and in the case of many crude oils, the sulfur content will be reduced below 1.0 weight percent.

EXAMPLE 3

A treating vessel was filled with 0.25 gallons of Iranian crude oil having an initial sulfur content of 1.49 weight percent and maintained at atmospheric pressures and at temperatures less than 60°F. To this crude oil 1 ounce of 200-mesh powdered Batesville marble hydrated lime was perculated through. After all of the hydrated lime had settled the treated crude oil was examined for sulfur content. The above test was then repeated using different amounts of hydrated lime. The results of these tests are found in Table 3 below:

Table 3

Effect of Amount of Hydrated Lime on Sulfur Level of Crude Oil

| AMOUNT OF HYDRATED LIME IN OUNCES | SULFUR CONTENT AFTER TREATMENT |
|---|---|
| 0.0 | 1.49 |
| 1.0 | 1.35 |
| 1.5 | 0.42 |
| 2.0 | 0.44 |
| 3.0 | 0.44 |

It is preferred that atmospheric pressure be employed, as this will allow sufficient contact time between the crude oil and the calcium hydroxide-containing material. Although some pressure in the reaction zone is allowable, it should not be so much that the contact time between the crude oil and calcium hydroxide-containing material is decreased to any great extent.

The reduction in the sulfur level will improve as the reaction temperature is decreased as is seen by Table 4. It appears that only at temperatures below about 100°F is significant sulfur reduction obtained. The lower limit of the temperature range would be that temperature which would not freeze the crude oil or increase its viscosity to the point that the hydrated lime could not perculate through the crude oil.

EXAMPLE 4.

A treating vessel was filled 1 quart of West Texas Sour crude oil having an initial sulfur content of 2.62 weight percent sulfur. Next, 200-mesh, powdered Batesville marble hydrated lime was perculated through one ounce of the crude oil maintained at 82°F and at atmospheric pressure. After all of the hydrated lime had perculated through the crude oil, the sulfur level of the treated crude oil was measured. This procedure was repeated, except that the reaction temperature was changed to 200°F.

Table 4

Effect of temperature on sulfur level of treated crude

| TEMPERATURE, °F | TREATED CRUDE OIL SULFUR LEVEL, WT.% (BATESVILLE) | TREATED CRUDE OIL SULFUR LEVEL, WT.% (PELICAN STATE) | TREATED CRUDE OIL SULFUR LEVEL, WT.% (INDUSTRIAL LIME) |
|---|---|---|---|
| 82 | 0.94 | 1.05 | 1.17 |
| 200 | 1.56 | 1.53 | 1.52 |

Other alternative steps and conditions are, of course, obvious to one skilled in the art and are included within the description of this invention.

Another advantage of the use of the calcium hydroxide-containing material under the conditions of this invention is that substantial reduction in the vanadium level of the crude oil is achieved. This can be important in subsequent refining processes such as coking.

EXAMPLE 5

A treating vessel was filled with 1 quart or Arabian crude oil having an initial sulfur content of 2.52 weight percent. To this crude oil was added 1 ounce of 200-mesh powdered marble hydrated lime which was allowed to perculate through the crude oil under atmospheric pressures and temperatures of about 50°F. The treated crude oil was then treated for its vanadium content and was found to contain only 0.004 weight percent, a 50% reduction from the initial untreated level.

What I claim is:

1. A crude oil desulfurization process which comprises:

a. contacting said crude oil with calcium hydroxide under ambient conditions to form a desulfurized crude oil product and a residue product; and b. separating said desulfurized crude oil product from said residue product.

2. A process according to claim 1 wherein said calcium hydroxide is in the form of hydrated lime.

3. A process according to claim 1 wherein said calcium hydroxide contacts said crude oil by perculating said material through said crude oil.

4. A process according to claim 3 wherein said material is uniformly perculated through said crude oil.

5. A process according to claim 1 wherein said calcium hydroxide and crude oil are agitated during contact.

6. A process according to claim 1 wherein said contacting occurs in a non-aqueous environment.

7. A process according to claim 1 wherein about one to two ounces of said calcium hydroxide is used per quart of said crude oil.

8. A crude oil desulfurization process which comprises:

a. contacting said crude oil with a marble hydrated lime of 200-mesh in a powder form at atmospheric pressures and temperatures less than about 100°F. to form a partially desulfurized crude oil product and a residue product; and, b. separating said desulfurized crude oil product from said residue product.

9. A process according to claim 8 wherein about one to four ounces of said hydrated lime is used per quart of said crude oil.

* * * * *